US008763165B2

(12) United States Patent
Söderström

(10) Patent No.: US 8,763,165 B2
(45) Date of Patent: Jul. 1, 2014

(54) PAIR OF MALE PANTS WITH AN ADJUSTABLE GENITAL POCKET

(75) Inventor: Peter Söderström, Stockholm (SE)

(73) Assignee: RevolutionWear Inc., Brookline, MA (US)

( * ) Notice: Subject to any disclaimer, the term of this patent is extended or adjusted under 35 U.S.C. 154(b) by 0 days.

(21) Appl. No.: 13/508,465

(22) PCT Filed: Nov. 6, 2010

(86) PCT No.: PCT/SE2010/000271

§ 371 (c)(1),
(2), (4) Date: May 7, 2012

(87) PCT Pub. No.: WO2011/056117

PCT Pub. Date: May 12, 2011

(65) Prior Publication Data

US 2012/0255102 A1 Oct. 11, 2012

(30) Foreign Application Priority Data

Nov. 6, 2009 (SE) ..... 0901420

(51) Int. Cl.
*A41B 9/02* (2006.01)
*A41B 9/00* (2006.01)

(52) U.S. Cl.
USPC ..... 2/403; 2/400; 2/227

(58) Field of Classification Search
USPC ..... 2/403, 40, 405, 400, 401, 404, 227, 2/228, 238, 237
See application file for complete search history.

(56) References Cited

U.S. PATENT DOCUMENTS

| | | | | | |
|---|---|---|---|---|---|
| 642,920 | A | * | 2/1900 | Potts | 602/69 |
| 2,050,410 | A | | 8/1936 | Baer | |
| 2,058,970 | A | | 10/1936 | Flesh | |
| 3,037,503 | A | * | 6/1962 | Ravaschieri | 602/69 |
| 3,207,155 | A | * | 9/1965 | Casey | 602/67 |

(Continued)

FOREIGN PATENT DOCUMENTS

| | | | |
|---|---|---|---|
| CA | 2 599 395 | A1 | 2/2009 |
| CN | 201238614 | Y | 5/2009 |

*Primary Examiner* — Gloria Hale
(74) *Attorney, Agent, or Firm* — Dickstein Shapiro LLP

(57) ABSTRACT

The invention refers to a pair of male pants intended to be used preferably by sportsmen and by other active persons and comprising a waist portion (2) connected to back and front portions (3, 4), which at the crotch (5) of the wearer are interconnected or merge into each other, said front portion (4) on its inside (6) comprises a sewn on pocket (7) having an upper free edge portion (8) extending in a direction inwards to the pants, the height position of the edge portion (8) is adjustably fixable in relation to the waist portion (2) by aid of an adjustment means (9) extending from said waist portion (2) and having two end portions (15;16). Said end portions (15; 16) of the adjustment means (9) are directly or indirectly adjustably fixable to the waist portion (2), at least one end portion (15; 16) of which is fixed to one end (22) of an adjustably fixable flexible strip (17; 18) constituting an extension of said end portion (15;16), which is fixable to said waist portion (2) with its other end (21), the extension degree of which is limited by a non extendable or rigid band (19; 20), which is extending over said flexible strip (17; 18) and is fastened to respective end (21;22) of the same in maintaining a desired smallest height position of the free edge portion (8).

3 Claims, 2 Drawing Sheets

(56) References Cited

U.S. PATENT DOCUMENTS

| | | | | | |
|---|---|---|---|---|---|
| 4,702,239 | A * | 10/1987 | Ichikawa | 602/67 |
| 4,863,084 | A * | 9/1989 | Nabozny | 224/673 |
| 5,870,779 | A * | 2/1999 | Heron | 2/403 |
| 6,041,441 | A * | 3/2000 | Counts et al. | 2/227 |
| 6,526,597 | B1 * | 3/2003 | Shepard | 2/255 |
| 2006/0096006 | A1 | 5/2006 | Soderstrom | |
| 2013/0000013 | A1 * | 1/2013 | Schifone | 2/403 |

* cited by examiner

PAIR OF MALE PANTS WITH AN ADJUSTABLE GENITAL POCKET

The present invention refers to a pair of male pants intended to be used preferably by sportsmen and by other active persons and comprising a waist portion connected to back and front portions, which at the crotch of the wearer are interconnected or merge into each other into a crotch portion.

Male pants used today and which can be found on the market in the form of underwear or sport trousers in many cases are provided with an inner trouser or a lining, which can be perforated in providing a certain air permeability. This lining is in some cases also intended to provide a supporting effect for the genitals of the man, above all his scrotum. In addition to those prior art trousers, especially those adapted for sport use, there exists specially shaped trousers or girdles intended to support the "package" and/or to retain it in the desired position. The disadvantages of those previously known arrangements are that the lined trousers fail to keep all of the genital unit in its proper location without the aid of further garments/products and that other help mentioned above for said securement of the positioning thereof is inconvenient and time-consuming to apply. The sportsmen having a special need of a solution in this area are for example marathon racers and sprinters The object of the present invention is to provide a type of male pants, which eliminates those problems mentioned above and which is easy to apply and which in an efficient way retain all of the genital unit in position without any need of additional garments/products. The characterizing features of the present invention are set forth in the claims enclosed.

Thanks to the invention a pair of male pants has been provided, which in an excellent way fulfils its purposes at the same time as it is both easy and not expensive to manufacture. The idea of the function of the pants according to the invention is that a solution has been achieved which very efficiently retain the whole package in a desired height position by aid of the height positioning of the upper free edge portion.

Figure 1:
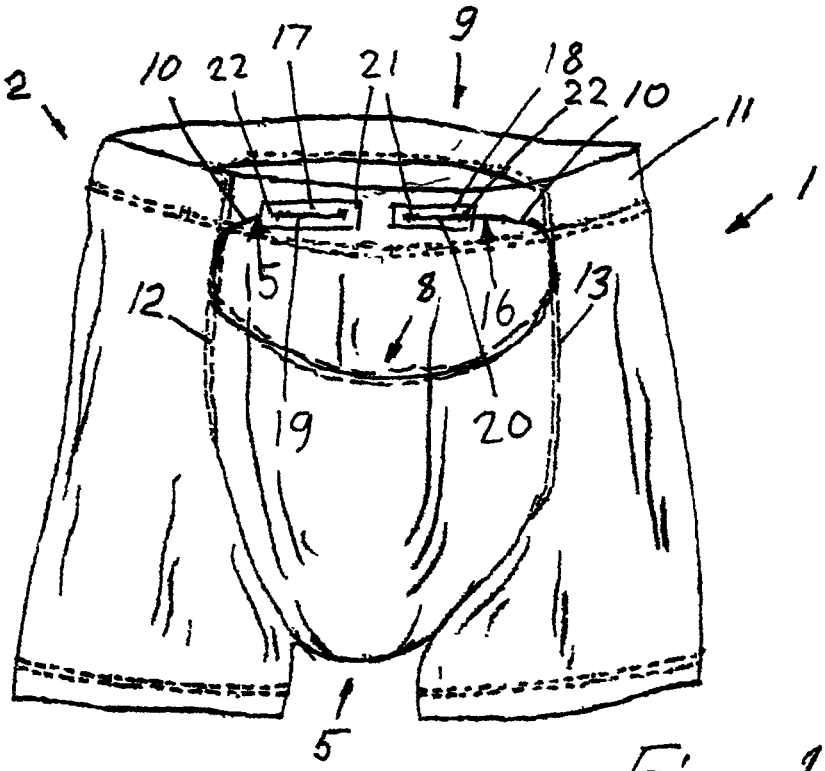
Figure 2:
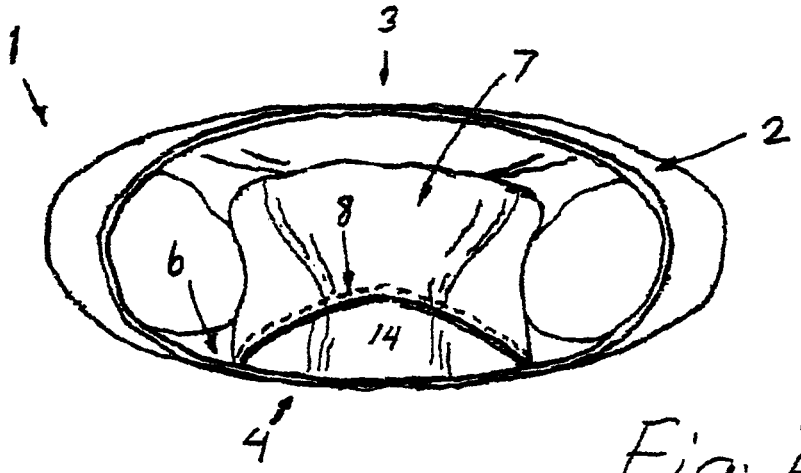
Figure 3:
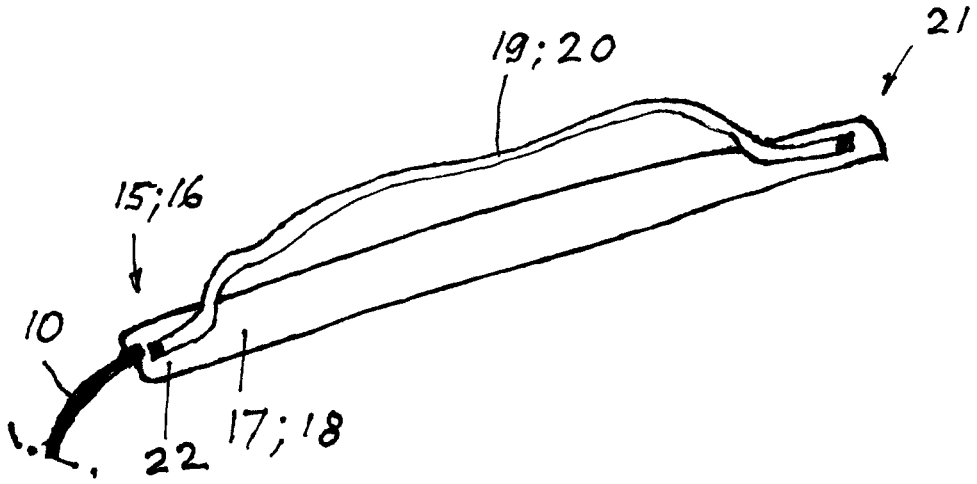
Figure 3:
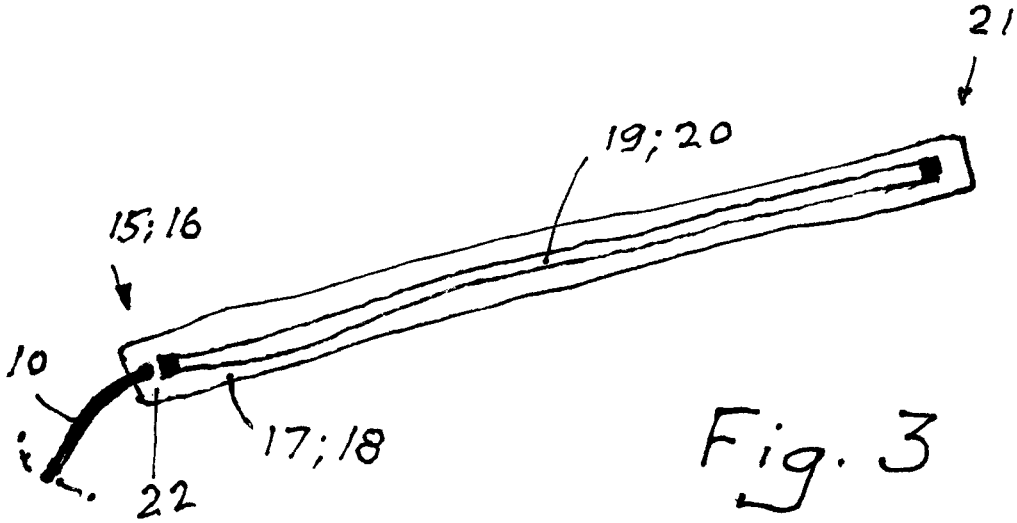

The invention is described closer below with help of a preferred embodiment example with reference to the accompanying drawings, in which FIG. 1 shows a schematic perspective view of a pair of male pants according to the invention having a pocket sewn into the same, the inner free, upper edge portion of which can be automatically positioned in the height direction, FIG. 2 shows a schematic perspective view of the pants illustrated in FIG. 1, viewed from above, and FIG. 3 shows two schematic part views of a flexible strip having a non-extendable band providing a limited flexibility of the flexible strip, said band is intended to indirectly fasten the free end portions of the adjusting means at the waist portion.

As can be seen from FIGS. 1 and 2 here is illustrated a preferred embodiment example of a pair of male pants 1 according to the present invention. The pair of male pants 1, which especially is adapted to be used by sportsmen and by other active persons, comprises a waist portion 2 connected to back and front portions 3 and 4. These merge into each other or are interconnected at a crotch 5 of the wearer. The front portion 4 of the male pants 1 does at its inner side 6 have a pocket 7 sewn thereon and comprising an upper, free edge portion 8 and the sides 12,13 of the pocket 7 are in the example illustrated sewn to the inside 6 of the pocket's 7 front portion 4 in the main part of the extension of the front portion 4 and further the front portion 14 of the pocket 7 consists of the inside 6 of the front portion 4 of the pants 1. The height position of the edge portion 8 can be automatically adjusted in relating to the waist portion 2 in a vertical direction and also when needed, e.g. during a first use of the pants. This adjustment into position is made indirectly via flexible strips 17,18 by aid of an adjusting means 9 extending from the waist portion 2 consisting of a thread or a strip 10 partly dependent on actual location of the genital unit on the body of the wearer and partly on the type of sport exercise in providing an anchoring and also a "push up" effect of the man's whole packet or genitals i.e. both the scrotum and penis. In the embodiment example illustrated the flexible strips 17,18 are fixed with one of their end 22 to the free end portions 15;16 of the strip 10 at the same time as the flexible strips 17,18 with their other end 21 can be adjustably fixable to the waist portion 2. In an alternative example the strip 10 can at its end portion 15;16 be extended and fixed to one and the same flexible strip 17;18. The strip 10 included in the adjusting means 9 can consist of an elastic, by which together with the flexible strips 17,18 the free edge portion 8 is tightened up in a direction forwards into a waist band 11 of the waist portion 2 intended for the location of the pants itself on the user. At the preferred embodiment example of the invention the two free end portions 15,16 of the adjustment means 9 are indirectly adjustably fixable along the waist portion 2 via the flexible strips 17,18, which have their extension degree limiting and at each end 21,22 of these fixed, not extendable or rigid bands 19,20.

In FIG. 3 a schematic enlargement of a flexible strip 17,18 is illustrated the degree of stretching of which is limited by a non-extendable or rigid band 19;20 fixed over the strip 17,18 at each end 21;22 of the same and said strips 17,18 together are provided to maintain an automatic height position after applying the pants at the same time as a smallest, earlier set in height position for the edge portion 8 can be maintained. The upper view is illustrating this flexible strip 17;18 in a natural, non-stretched or not extended condition and the lower view illustrates the same strip 17;18 in a limited extended condition.

The invention claimed is:

1. A pair of male pants comprising:

a waist portion connected to a back portion and a front portion, wherein the back and front portions are connected at a crotch area of a wearer, said front portion comprises a sewn in pocket on an inside portion of the front portion having an upper free edge portion extending in an inwards direction, wherein the horizontal edge portion of the pocket has a height that is vertically adjustable in relation to the waist portion by aid of an adjustment means extending from said waist portion and having two end portions, wherein at least one of said end portions of the adjustment means-is fixed to one end of a flexible strip and the other end of the flexible strip is fixable to the waist portion, wherein the flexible strip has a degree of extension that is limited by a non-extendable, rigid band in order to maintain a desired horizontally extending minimum vertical height position of the free edge portion.

2. A pair of male pants according to claim 1, wherein the adjustment means consists of an elastic and at least one flexible strip, said flexible strip is fixed by one of its ends to said elastic.

3. A pair of male pants according to claim 2, wherein the elastic, the flexible strip, and the non-extendable, rigid band is fixed to a waist band of the waist portion for fixation of a position of the pants on the wearer.

* * * * *